US009365338B2

(12) United States Patent
Schaefer

(10) Patent No.: US 9,365,338 B2
(45) Date of Patent: Jun. 14, 2016

(54) COVER FOR BUILDING SIDING BOARDS

(71) Applicant: Fiber Cement Foam Systems Insulation, LLC, Manalapan, NJ (US)

(72) Inventor: Russ Schaefer, Manalapan, NJ (US)

(73) Assignee: Fiber Cement Foam Systems Insulation, LLC, Manalapan, NJ (US)

( * ) Notice: Subject to any disclaimer, the term of this patent is extended or adjusted under 35 U.S.C. 154(b) by 319 days.

(21) Appl. No.: 13/951,613

(22) Filed: Jul. 26, 2013

(65) Prior Publication Data

US 2014/0027343 A1 Jan. 30, 2014

Related U.S. Application Data

(60) Provisional application No. 61/675,895, filed on Jul. 26, 2012.

(51) Int. Cl.

| | |
|---|---|
| ***B65D 5/02*** | (2006.01) |
| ***B65D 71/06*** | (2006.01) |
| ***B65D 71/02*** | (2006.01) |
| *B65D 81/24* | (2006.01) |
| *B65D 81/26* | (2006.01) |
| *B65D 85/46* | (2006.01) |

(52) U.S. Cl.

CPC ..... *B65D 71/06* (2013.01); *B65D 71/02* (2013.01); *B65D 81/24* (2013.01); *B65D 81/26* (2013.01); *B65D 85/46* (2013.01)

(58) Field of Classification Search

CPC ..... B65D 71/06; B65D 65/02
USPC ..... 206/597; 150/154; 220/9.4, 1.5
See application file for complete search history.

(56) References Cited

U.S. PATENT DOCUMENTS

| | | | | | |
|---|---|---|---|---|---|
| 3,416,652 | A | * | 12/1968 | Almasy | 206/453 |
| 3,416,692 | A | | 12/1968 | Cline et al. | |
| 3,557,855 | A | | 1/1971 | Weingarten et al. | |
| 3,834,292 | A | | 9/1974 | Sund | |
| 4,000,815 | A | * | 1/1977 | Wingbro et al. | 206/205 |
| 4,030,600 | A | * | 6/1977 | Heaps | 206/597 |
| 4,244,411 | A | | 1/1981 | Karlstrom et al. | |
| 4,793,507 | A | | 12/1988 | Delplanque | |
| 4,852,330 | A | * | 8/1989 | Carangelo | 53/399 |
| 4,871,063 | A | | 10/1989 | Kumbier | |
| 5,383,408 | A | * | 1/1995 | Searcy | 108/57.16 |
| 5,423,428 | A | | 6/1995 | Selz | |
| 5,441,154 | A | * | 8/1995 | Youell, III | 206/599 |
| 5,549,202 | A | * | 8/1996 | Whiteside | 206/436 |
| 5,655,679 | A | | 8/1997 | Schutz | |

(Continued)

FOREIGN PATENT DOCUMENTS

| | | | |
|---|---|---|---|
| EP | 0734967 | B1 | 10/1996 |
| EP | 1370466 | B1 | 8/2007 |

(Continued)

*Primary Examiner* — King M Chu
(74) *Attorney, Agent, or Firm* — Gearhart Law, LLC

(57) ABSTRACT

This disclosure provides a cement board bay comprising a skid, the cement boards and a cover to protect the boards from whether. The cover is of breathable water proof material and it has a skirt that elastically or otherwise tightens the cover over the boards. The cover is secured with closing devices. The upper surface of the cover may include ridges, convex portions or water absorbent areas to prevent water from standing on the bay. The cover sides may include flap openings for removing tapes holding the boards on place without removing the bay cover.

13 Claims, 5 Drawing Sheets

(56) References Cited

U.S. PATENT DOCUMENTS

| | | | | |
|---|---|---|---|---|
| 5,725,089 | A * | 3/1998 | Ravet et al. | 206/83.5 |
| 5,898,968 | A * | 5/1999 | Beattie | A63B 47/04 15/210.1 |
| 6,101,955 | A * | 8/2000 | Salce | 108/51.11 |
| 6,454,113 | B1 | 9/2002 | Schutz | |
| 6,540,085 | B1 | 4/2003 | Davies | |
| 6,598,540 | B2 | 7/2003 | Austin et al. | |
| 6,907,712 | B2 | 6/2005 | Garfinkle | |
| 7,318,392 | B2 * | 1/2008 | Rosen et al. | 119/497 |
| 7,934,894 | B1 * | 5/2011 | Temple | 410/97 |
| 7,958,995 | B2 | 6/2011 | Dedmon et al. | |
| 7,987,796 | B2 | 8/2011 | Nordstrom et al. | |
| 2002/0002937 | A1 * | 1/2002 | Modesitt et al. | 108/57.34 |
| 2002/0078661 | A1 * | 6/2002 | Bowden et al. | 53/397 |
| 2004/0089572 | A1 | 5/2004 | Takahashi | |
| 2006/0278311 | A1 * | 12/2006 | Mittelstaedt | A45C 3/08 150/105 |
| 2007/0068612 | A1 * | 3/2007 | Potter | A63B 57/60 150/160 |
| 2007/0289682 | A1 * | 12/2007 | Young | 150/154 |
| 2008/0029421 | A1 * | 2/2008 | Trickett | 206/503 |
| 2008/0196304 | A1 | 8/2008 | Pope | |
| 2009/0008005 | A1 * | 1/2009 | Chu | 150/154 |
| 2009/0277901 | A1 * | 11/2009 | Port et al. | 220/9.4 |
| 2009/0288980 | A1 * | 11/2009 | Hadala | 206/597 |
| 2011/0186196 | A1 * | 8/2011 | Betlem | 150/165 |

FOREIGN PATENT DOCUMENTS

| | | | |
|---|---|---|---|
| EP | 1428763 | B1 | 9/2007 |
| GB | 1531581 | A | 11/1978 |
| JP | 1267108 | A | 10/1989 |
| WO | WO02072433 | A2 | 9/2002 |

* cited by examiner

COVER FOR BUILDING SIDING BOARDS

PRIORITY

This application claims priority of the U.S. Provisional Patent Application No. 61/675,895 filed on Jul. 26, 2012, the contents of which is incorporated herein by reference in its entirety.

FIELD OF THE INVENTION

The invention relates to transportation and storage of building materials, in particular, transportation and storage of siding boards such as fiber cement boards.

BACKGROUND OF THE INVENTION

The present invention relates to transportation and storage of building materials, in particular, transportation of siding boards such as fiber cement boards. The siding boards customarily come from a building supplier strapped on pallets and wrapped in plastic. Once the contractor opens the package it is not reusable but has to be removed and thrown away. Thus if all the elements are not used at once they are left loose and are probably be covered by a plastic sheet or equivalent that may not stay in place for example in windy conditions.

The art of transporting materials includes various kinds of pallet wraps, however these systems are meant for cubic pallets. The present inventions addresses special needs of covering building materials such as longitudinal siding boards. Therefore the existing systems are not usable for protecting such materials during storage and transportation. Furthermore, the prior art does not provide solutions to specific features of transporting and storing siding boards, for example avoiding water collecting on covered pallets when they stand for days on the construction site.

U.S. Pat. No. 7,934,894 discloses a reusable pallet wrap for securing lading on pallets. The system consists of an adjustable flexible wrap made from one rectangular shaped cloth and the system has hook and loop fasteners sewn on the ends. The ends run from top to bottom of the wrap. Squares of hook and loop fastener are secured to the bottom of the wrap that line up with each corner of the pallet. Sewn into these squares are straps that are passed under the pallet to connect the wrap to the pallet. Once this is done, the load is secured to the pallet. Two straps with hook and loop fastener ends are also sewn directly to the wrap that gives an added stability to load as well as to secure the wrap. Finally, a top cover can be added if load requires protection from the elements.

U.S. Pat. No. 6,540,085 discloses a reusable bulk packaging comprising a plastics bag having an opening which is closable by means of a zip fastener attached to the body of the bag, typically by means of an adhesive or by welding. The plastics bag may be made out of bubble film, optionally laminated to aluminum foil.

U.S. Pat. No. 4,871,063 discloses a pallet cover for protecting the upper surfaces of a load resting upon a pallet. The pallet cover is made of multiple layers that are laminated together. There are no staples or like materials used. The pallet cover is a one piece unit comprised of a horizontal upper surface, a bend, and for generally vertical flanges. The flanges are connected to the upper surface at the bend. The flanges are independently flexible along the bend.

U.S. patent application Ser. No. 2008/0196304 discloses a lightweight, removable cover for harvested vegetative material, such as sod, stacked on a pallet. A cover includes a top panel with side and end panels extending downwardly from the top panel to form an envelope shaped to fit snugly over the stacked material. The stacked material is arranged in a shape of predetermined length, breadth and height, and the envelope is configured to have a corresponding shape. The envelope surrounds the stacked material without enclosing the pallet. The length and breadth of each panel of the envelope corresponds to a respective portion of the shape of the stacked material. In addition, each panel comprises a flexible material that is impervious to moisture. An outside surface of each panel is light and heat reflective to protect the covered material and an inside surface is non-reflective. One or more of the panels includes promotional and/or information indicia on an outside surface thereof.

U.S. Pat. No. 5,423,428 discloses a palletized load cover. The cover includes at least one elastic strap which is held captive on the cover. Integral connectors are provided on each end of the strap and the connectors cooperate with a conventional pallet including at least two retractable belts which can be locked against further unwinding when unwound. Guides are provided on the cover to restrict lateral movement of the strap while permitting limited longitudinal movement of the strap. The connectors provided on each end of the elastic strap are operable to releasably lock with cooperating connectors provided on distal ends of the pallet belts. With the belt connectors locked to the strap connectors at each end of the strap, the belts are pulled so that the belt retracts and is locked against unwinding. The elasticity of the strap makes it possible, with conventional belt retractor mechanisms, to achieve an unprecedented level of strap tightness, thereby making a palletized load secured with a cover according to the invention significantly more secure than has been possible with prior art load covers. In addition, the strap connects belts from opposed sides of the pallet and maintains or restores equal tension in the two belts, continuously. In one embodiment, a single elastic strap, in the form of a closed loop, is provided on the cover and it is operable to equalize tension in four pallet belts secured to it.

U.S. Pat. No. 7,958,995 discloses a palletized shipping container for bulk handling of liquids and fluent materials and has a collapsible inner bag enclosed in a flexible outer liner/bag having rigid stiffener panels in pocketed sides. The inner bag has a bung at its top end for filling or discharge and a valve fitment near the bottom for receiving a discharge valve. Tape tabs at upper ends of the inner bag and outer liner/bag attach to the top panel and/or stiffener panels to maintain the bags in an erect uncollapsed configuration. The stiffener panels prevent bulging of the inner bag and provide vertical support, but their lateral sides are spaced apart and form non-structural "floating corners" to maximize volume, minimize shock, vibration and abrasive forces on the inner bag, yet maintain impact and compression strength meeting international certification standards. The bung is disposed beneath the top panel after filling the bag to prevent access and provide a tamper resistant assembly.

Accordingly, there is a need for a system and method to specifically protect building siding boards, such as cement board siding materials during storage and transportation.

Embodiments of this invention are illustrated in the accompanying drawings and will be described in more detail herein below.

SUMMARY OF THE INVENTION

The invention of the present disclosure is distinguished over the prior art in general and particularly the instant disclosure solves the above flaws of the prior art.

It is an object of this invention to provide easy to use protection system for storage and transport building siding boards such as fiber cement siding boards.

It is another object of this invention to provide a water proof system to protect the boards against weather.

A further object of this invention is to provide a protection system for storage and transportation of building siding boards that prevents water from collecting on top of the covered piles when materials are stored outside for extended periods of time.

Yet another object of this invention is to provide a protection system for storage and transportation of building siding boards, where the protective cover allows cutting of the original straps or tapes holding the boards, without uncovering the bay.

It is yet another object of this invention to provide a flexible system to adjust to protect variable number of the siding boards.

It is still another object of this invention to provide light weight and reusable protection system for the siding boards.

A further object of this invention is to provide a protection system for siding boards that can be easily assembled and removed when the boards are loaded on a truck or when the original plastic wrapping is opened at the construction site.

It is an object of this invention to provide a waterproof cover for building material; said cover being longitudinal and rectangular in shape and having an upper surface, two side surfaces, two end surfaces, and a skirt portion, said skirt portion being connected to the two side surfaces and the two end surfaces; and at least two closing devices attached to the cover; wherein the cover is pulled over the building material loaded on a skid, and the skirt portion tightens the cover over the material, and the cover is secured with the closing devices.

It is another object of this invention to provide a cement board bay comprising: a skid; said skid being a rectangular surface having two long sides and two short sides, a stack of cement boards loaded on the skid; a waterproof breathable cover; said cover having an upper surface, two side surfaces, two end surfaces, and a skirt portion being connected to the two side surfaces and the two end surfaces; and at least two closing devices attached to the cover; wherein the cover is pulled over the cement boards, and the skirt portion tightens the cover over the boards, and the cover is secured with the closing devices.

BRIEF DESCRIPTION OF THE DRAWINGS

FIG. 7A also shows flap-structures.

DESCRIPTION OF THE PREFERRED EMBODIMENTS

Figure 1:
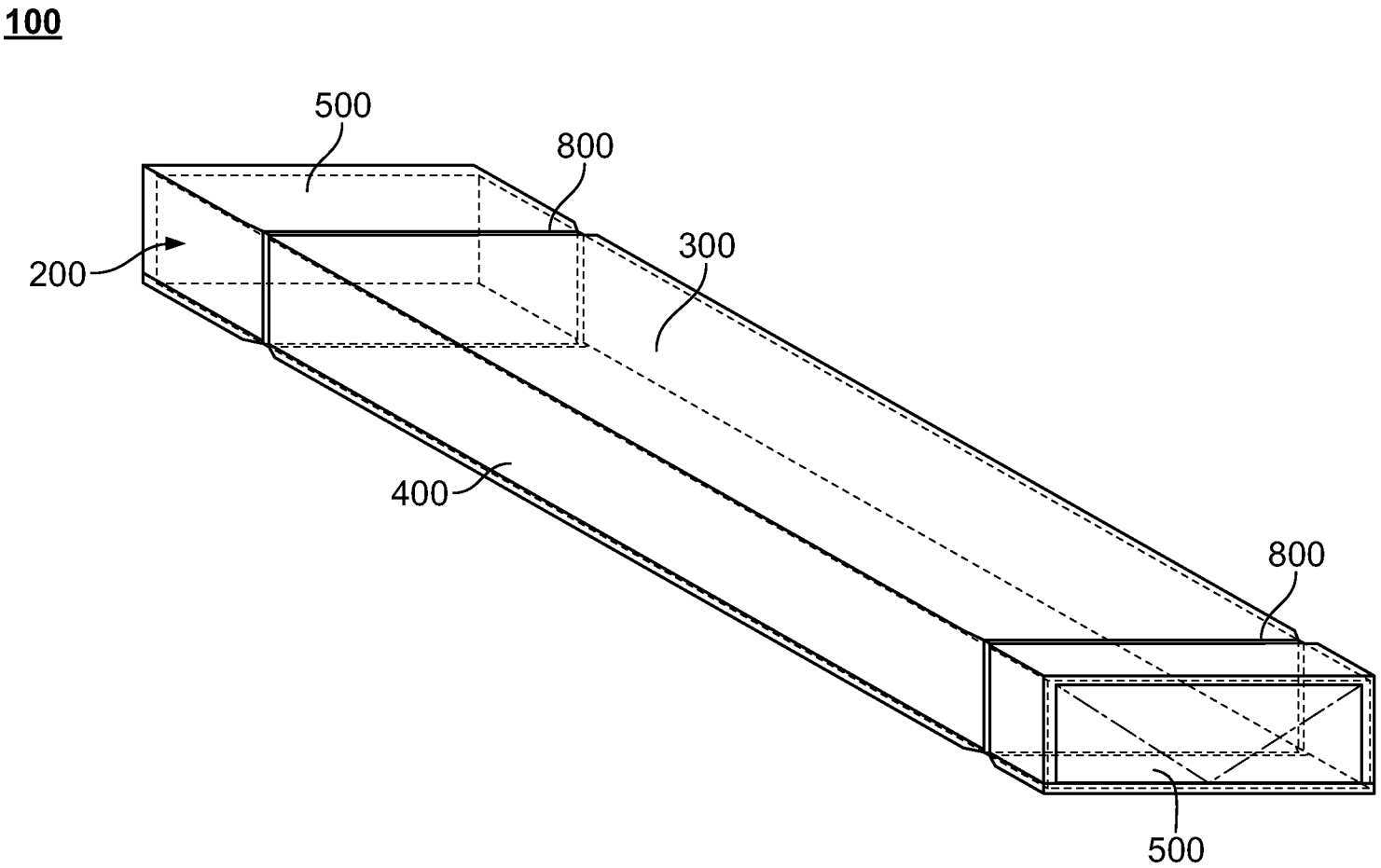
FIG. 1 is an isometric view of a preferred embodiment of the invention.

The preferred embodiments of the present invention will now be described with reference to FIG. 1-8 of the drawings. Identical elements in the various figures are identified with the same reference numerals.

FIG. 1 is an isometric view of the cement board bay 100. The figure shows a cover 200 having an upper surface 300, two side surfaces 400, and two end surfaces 500 and two closing devices 800.

Figure 2:
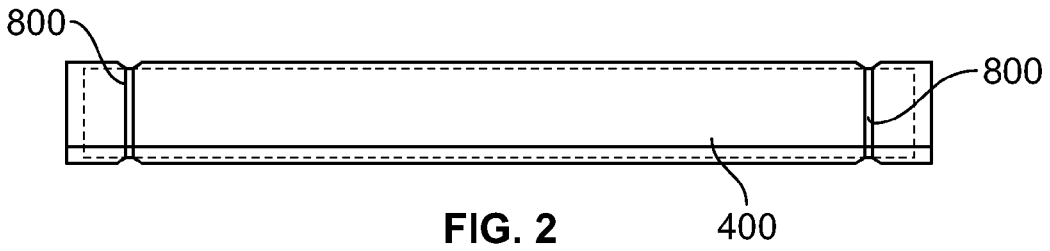
FIG. 2. is a side view of a preferred embodiment of the invention.

FIG. 2 is a side view of a preferred embodiment showing one side surface 400 and two closing devices 800.

Figure 3:
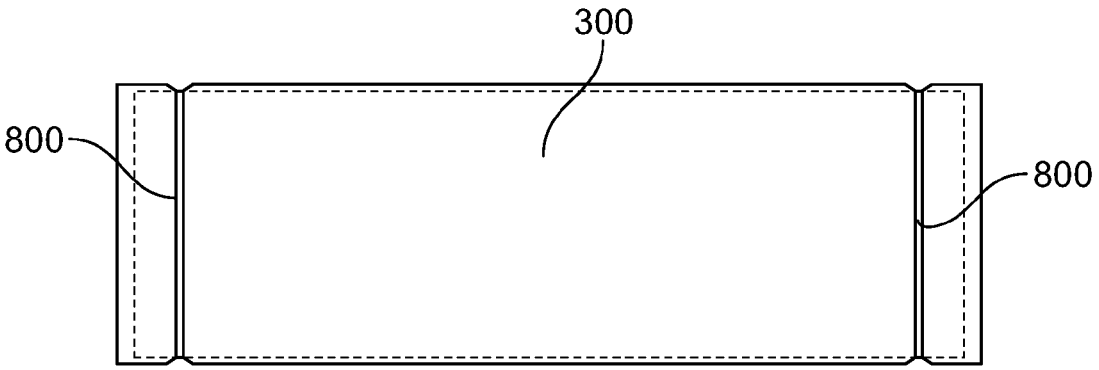
FIG. 3 a top view of a preferred embodiment of the invention.

FIG. 3 is a top view of a preferred embodiment showing the upper surface 300 and the closing devices 800.

Figure 4:
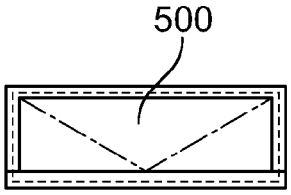
FIG. 4 is an end view of a preferred embodiment of the invention.

FIG. 4 is an end view of a preferred embodiment showing an end surface 500.

Figure 5:
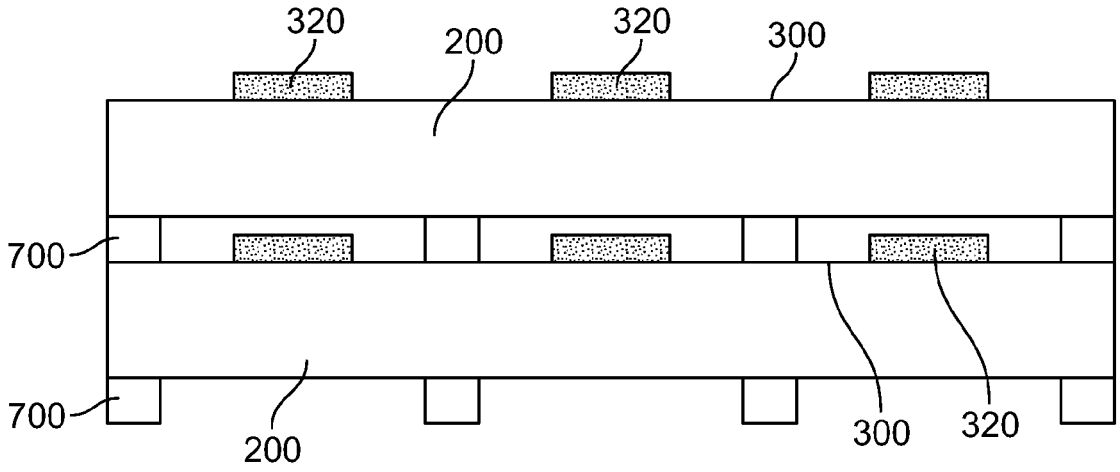
FIG. 5. is an elevated side view of bays piled on top of each other, where the covers include areas of water absorbing material.

FIG. 5 is an elevational side view of two cement board bays piled on top of each other. The figure shows the skids 700, the covers 200, and water absorbing areas 320 on the top surface 300 of the covers.

Figure 6A:
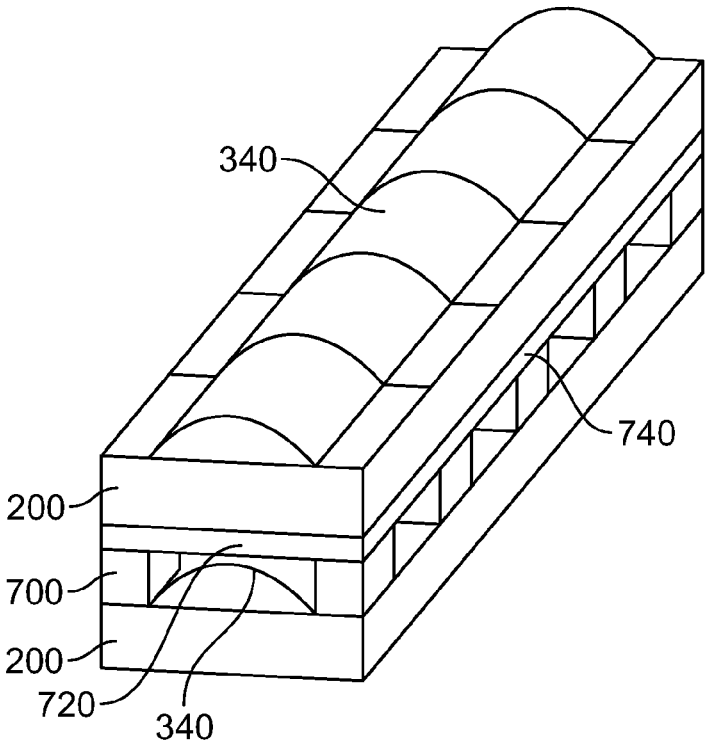
FIGS. 6A and 6B are isometric views of preferred embodiments where the top side of the cover forms convex or ridge-like areas.

FIG. 6A is an isometric view of a preferred embodiment of the invention, showing two cement board bays piled on top of each other. The figure shows the skids 700, the short side 720 and the long side 740 of the skids, the covers 200, and a convex area 340 on the top surface of the covers.

Figure 6B:
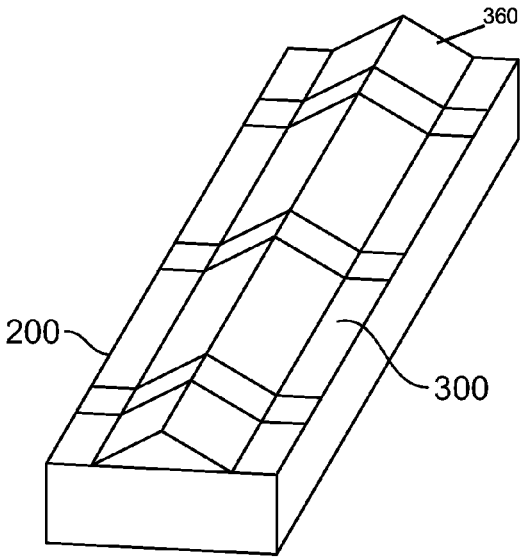

FIG. 6B is an isometric view of a preferred embodiment of the invention, showing the cover 200, and a ridged area 360 on the top surface 300 of the cover.

Figure 7A:
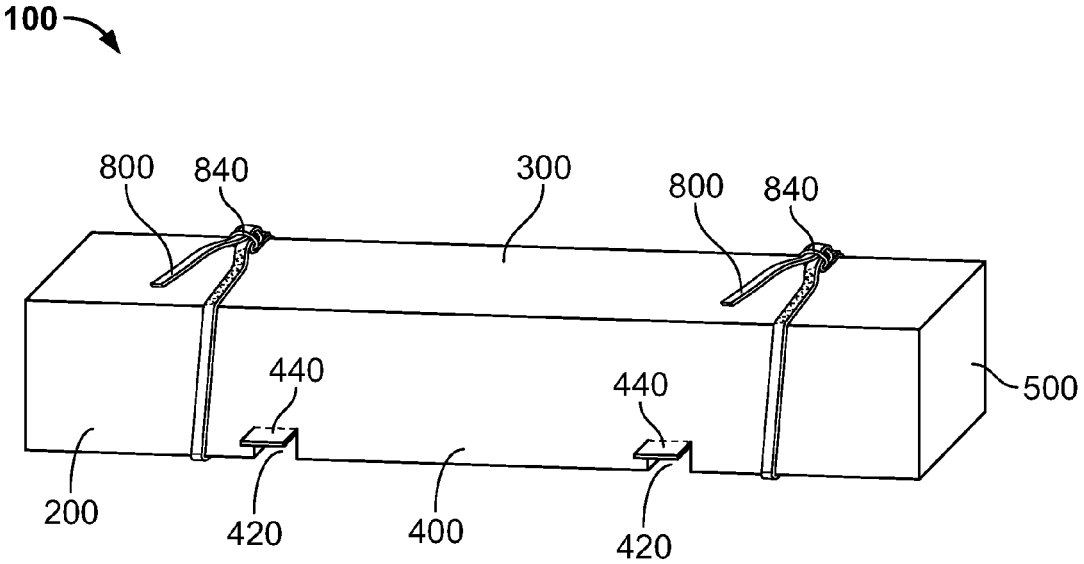
FIGS. 7A and 7B show preferred embodiments for attachment of the straps.

FIG. 7A is an elevated side view of a preferred embodiment of the invention showing the cement board bay 100, the cover 200, the upper surface 300, the side surface 400, the end surface 500, two closing devices 800, two double rings 840, two flap openings 420 and two flap covers 440.

Figure 7B:
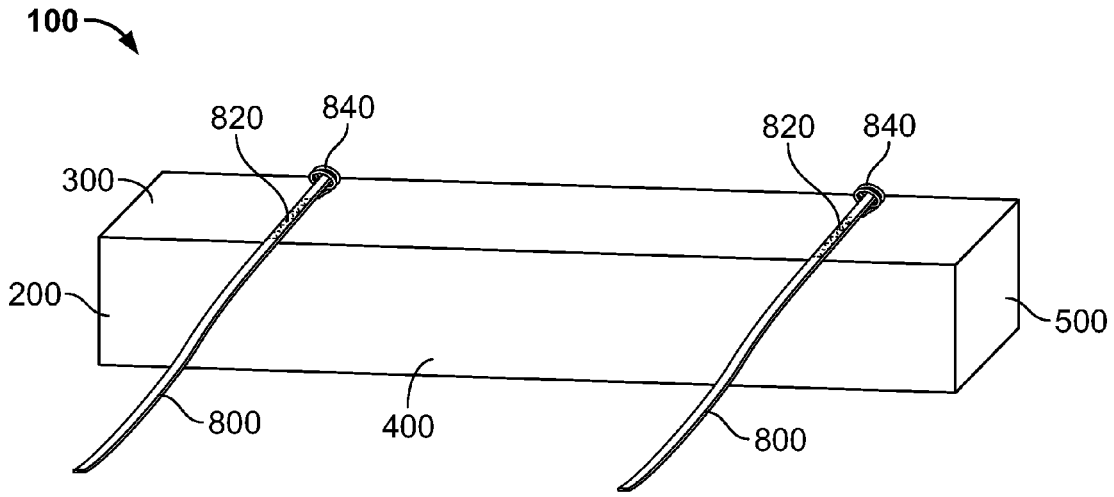

FIG. 7B is an elevated side view of a preferred embodiment of the invention showing the cement board bay 100, the cover 200, the upper surface 300, the side surface 400, the end surface 500, two closing devices 800, two stitched areas 820 and two double rings 840.

Figure 8A:
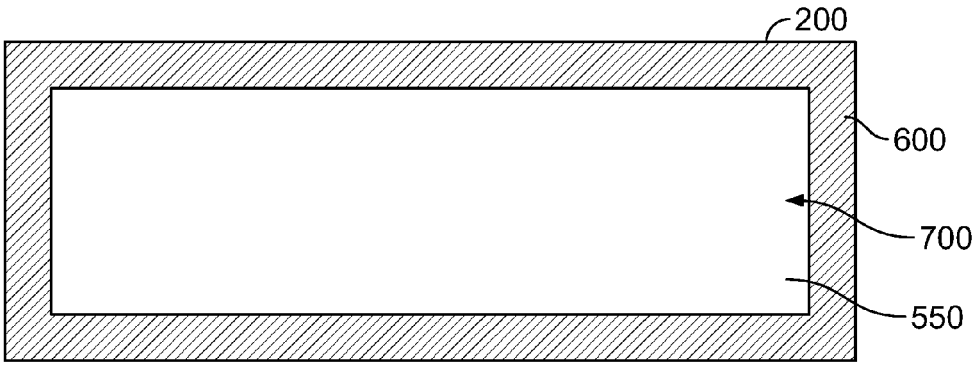
FIGS. 8A and 8B show bottom view of preferred embodiments of this invention.

FIG. 8A shows a bottom view of a preferred embodiment of the invention, showing the skid 700, the cover 200, the open bottom 550 and a skirt portion 600.

Figure 8B:
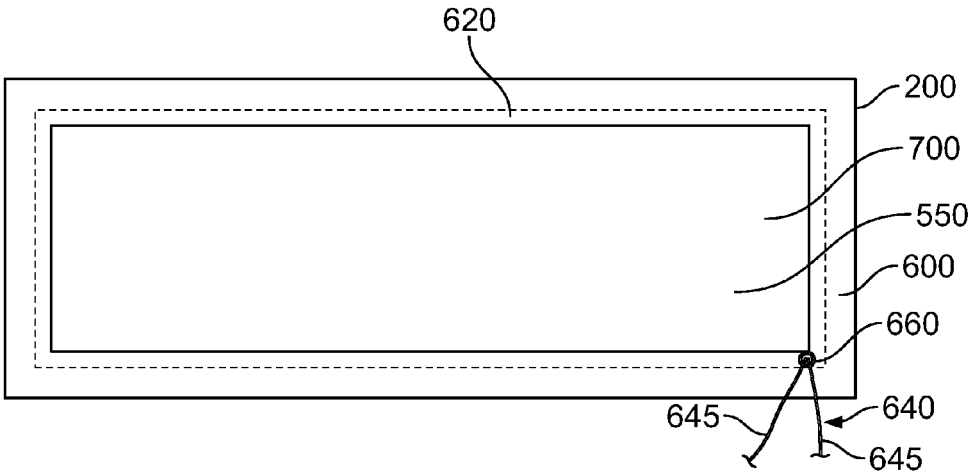

FIG. 8B shows a bottom view of another preferred embodiment of the invention showing the skid 700, the cover 200, the open bottom 550, a skirt portion 600, a string channel 620, a pulling string 640, two loose ends of the sting 645, and a string opening 660.

The present invention is now further described by way of example only with reference to accompanying drawings.

The cement siding boards are customarily loaded on skids (pallets) and covered with plastic that is bound together with plastic tape. The skids customarily have an elongated rectangular shape with long side being 10' (3.05 m) to 15' (4.57 m) long and the short side being between 40" (1.02 m) and 60" (1.52 m) wide. The skids are shown in FIG. 6A as element number 700. FIG. 6 A shows also the long 740 and the short 720 sides of the skid.

When the contractor receives the pallets, the cement boards are usually bound together with tape or straps and covered with plastic. The contractor has to rip the plastic open and cut the tape to be able to use the cement boards. If he is not using all the boards at one time, he usually leaves the boards on the skid where they will be exposed to the weather.

The invention according to this disclosure provides a cement board bay that includes a cover designed to protect the boards, prevents water standing on top of the bays and enables cutting of the original tapes or straps without removing the cover.

Referring now to FIGS. 1-4, the cover 200 is longitudinal and rectangular in its form so as to cover the elongated rectangular stack of boards on the skid. The cover has an upper surface 300, two side surfaces 400 and two end surfaces 500. According to a preferred embodiment the length of the upper surface 300 and the side surfaces 400 is 5' (1.52 m) to 20' (6.10 m), more preferably 12' (3.65 m) to 13' (3.96 m), and most preferably 12'6" (3.81 m). The width of the end surfaces 500 is between 20" (50.8 cm) and 60" (1.52 m), more preferably between 50" (1.27 m) and 55" (1.40 m), and most preferably 53" (1.35 m). The ratio of the width to the length of the cover is approximately between 1:2. and 1:4. According to the most preferred embodiment the ratio is 1:2.45. The height of the side surfaces varies between 12" (30.5 cm) to 6' (1.83 m).

Once the cover 200 is set to cover the boards, the cement board bay 100 is secured with the closing devices 800. The cover may be pulled over the skid as shown for example in FIG. 8A, or it may be pulled to cover the boards only as is shown in FIG. 6A for example.

Referring now to FIGS. 8A and 8B, the cover 200 is so designed that it can be easily pulled over the cement boards loaded on a skid 700. This is enabled by the design on the bottom side of the cover. Namely, the cover 200 has an open bottom 550 surrounded by a skirt portion 600. According to one preferred embodiment shown in FIG. 8A the skirt portion 600 is made of elastic material (hatched are in the figure). The elastic material may be rubber band, but other elastic materials may also be used. According to another preferred embodiment the skirt portion may include a string channel 620 as shown in FIG. 8B. The string channel 620 may enclose a rubber band to tighten the cover 200 from the bottom side of the bay 100. Alternatively, the string channel may enclose a pulling string 640 that has two loose ends 645 protruding from a string opening 660 and when the contractor wants to tighten the cover 200 on top of the cement boards, he simply pulls the string ends 645 to tighten the bottom side of the bay 100. According to a simplified embodiment the cover is a rectangle surrounded by the string channel and once the rectangular cover is set on top of the bay pulling the loose ends of the string would tighten the cover on the bay.

Now referring to FIGS. 7 A and B, the closing devices 800 are preferably straps. The straps may not be attached to the cover 200, but according to one preferred embodiment they are attached on the upper surface 300 with a stitched area 820 as shown in FIG. 7B. The stitched area 820 may equally well locate on either one of the two side surfaces 400 of the cover. Instead of stitching, the straps may be attached to the cover with other feasible methods such as hoop and loop fastener, hooks, buttons or other means.

The contractor will pull the straps around the bay 100 and according to one preferred embodiment the cover 200 includes double rings 840 through which the strap is slipped and tightened by pulling the straps as shown in FIG. 8A. According to other preferred embodiments instead of a double ring, a single ring, or a hook may be used to tighten the straps and the straps may be secured to tightened position with hoop and loop fastener, such as Velcro®, buttons, press fasteners, or press studs.

The straps may be made of any feasible material. They may be elastic or non elastic.

Now referring to FIGS. 5, 6A and 6B, the invention according to this disclosure also solves the problem of water standing on the bays 100. The upper surface 300 may include areas with water absorbing material 320 as shown in FIG. 5. An example of such water absorbing material may be sponge, but other materials may also be used. The water absorbing material may be a unite area or it may include several separate areas as shown in FIG. 5. An alternative way to avoid water standing on the bays 100 is to include convex areas 340 as shown in FIG. 6A or ridged areas 360 as shown in FIG. 6B on the upper surface 300. Such convex or ridged areas will prevent water from standing on the bay. The ridges or convex areas would not prevent piling several bays on top of each other as the skids customarily have empty space beneath them.

When the contractor receives the cement boards he may not want to use them immediately but wants to cover them with the cover 200 because the original plastic is weak and can be ripped by wind. At the time he decides to use the boards, he still needs to cut the original tapes or straps that hold the boards in piles. With the current invention, he can cut the original tapes or straps through the flap openings 420 that are covered by flap cover 440 as shown in FIG. 7A. The flap openings are so placed that they coincide with the original straps or tapes. Preferably there are at least 2 flap openings on each side surface of the cover. Once the contractor cuts the original tapes through the flap openings, he can remove part of the cover 200 and pull out the number of cement boards he needs and easily cover the rest of the boards by pulling the cover 200 back on its place.

According to a preferred embodiment the cover 200 is made of breathing water resistant material. Such material may be woven or non woven. The cover may be made of natural or synthetic fabrics laminated or coated with waterproofing material such as rubber, polyvinyl chloride PVC, polyurethane PU, silicone elastomer, fluoropolymers or wax, but any other feasible material may also be used.

According to one preferred embodiment the cover may contain advertisements, instructions or other information or promotional information.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A waterproof cover for building material;

said cover being longitudinal in shape and having an upper surface, two side surfaces, two end surfaces, and a skirt portion, said skirt portion being connected to the two side surfaces and the two end surfaces; and at least two closing devices attached to the cover;

wherein the cover is pulled over the building material loaded on a skid, and the skirt portion tightens the cover over the material, and the cover is secured with the closing devices, wherein the closing devices are straps and a double ring is attached to the cover; and wherein the straps have a first end and a second end, the first end being attached to the upper surface of one of the side surfaces of the cover, and wherein the second end of the straps are secured to the double ring after pulling the straps around the building material and the skid wherein the upper surface has at least one convex or ridged area that extends between the two end surfaces wherein said convex or ridged area protrudes from the upper surface.

2. The cover of claim 1, wherein the building material is fiber cement boards and the long sides are 10 to 15 feet long and the short sides are 40 to 60 inches wide.

3. The cover of claim 1, wherein a top surface of the upper surface contains areas of water absorbent material.

4. The cover of claim 1, wherein the cover is made of breathable woven or non-woven material.

5. The cover of claim 1, wherein the side surfaces contain at least one flap opening covered by flap cover.

6. The cover of claim 1, wherein the skirt portion is made of elastic material.

7. The cover of claim 1, wherein the skirt portion has a string channel and a string inserted into the channel, and the string having two loose ends protruding from a hole in the channel, thereby enabling tightening the skirt portion by pulling from the ends of the string.

8. A fiber cement board bay comprising:

a skid:

said skid being a rectangular surface having two long sides and two short sides, said long sides being 10 to 15 feet long and the short sides being 40 to 60 inches wide;

a stack of fiber cement boards loaded on the skid;

a waterproof cover;

said cover having an upper surface, two side surfaces, two end surfaces, and a skirt portion, said skirt portion being connected to the two side surfaces and the two end surfaces; and at least two closing devices attached to the cover;

wherein the cover is pulled over the fiber cement boards, and the skirt portion tightens the cover over the boards, and the cover is secured with the closing devices, wherein the closing devices are straps and a double ring is attached to the cover; and wherein the straps have a first end and a second end, the first end being attached to the upper surface of one of the side surfaces of the cover, and wherein the second end of the straps are secured to the double ring after pulling the straps around the bay.

9. The bay according to claim 8, wherein the skirt portion is made of elastic material.

10. The bay according to claim 8, wherein the skirt portion has a string channel and a string enclosed in the channel, and wherein the string has two loose ends protruding from a pulling string hole, whereby the cover can be tightened by pulling the string ends.

11. The bay according to claim 8, wherein the side surfaces have at least one flap opening covered by flap covers.

12. The bay according to claim 8, wherein the upper surface has at least one area comprising of water absorbent material.

13. The bay according to claim 8, wherein top surface of the upper surface has at least one convex or ridged area.

* * * * *